US006926079B2

(12) United States Patent
Kensok et al.

(10) Patent No.: US 6,926,079 B2
(45) Date of Patent: Aug. 9, 2005

(54) HUMIDITY CONTROLLER

(75) Inventors: Timothy J. Kensok, Minnetonka, MN (US); Timothy M. Tinsley, Coon Rapids, MN (US)

(73) Assignee: Honeywell International Inc., Morristown, NJ (US)

( * ) Notice: Subject to any disclaimer, the term of this patent is extended or adjusted under 35 U.S.C. 154(b) by 227 days.

(21) Appl. No.: 10/303,181

(22) Filed: Nov. 25, 2002

(65) Prior Publication Data

US 2004/0099411 A1 May 27, 2004

(51) Int. Cl.[7] ..... F24F 3/14
(52) U.S. Cl. ..... 165/230; 165/222
(58) Field of Search ..... 165/230, 222, 165/229, 287

(56) References Cited

U.S. PATENT DOCUMENTS 2,110,025 A * 3/1938 Ridge ..... 165/222
2,751,197 A * 6/1956 Herrman et al. ..... 165/230
3,305,173 A * 2/1967 Beckman ..... 236/9 R
3,670,809 A 6/1972 El-Tahry
4,042,016 A 8/1977 Boochever et al.
4,136,730 A 1/1979 Kinsey
4,735,054 A * 4/1988 Beckey ..... 62/93
4,974,665 A * 12/1990 Zillner, Jr. ..... 165/229
5,353,862 A * 10/1994 Akiyama ..... 165/229
5,435,146 A * 7/1995 Clark ..... 62/126
5,450,893 A * 9/1995 Galba et al. ..... 165/229
5,675,979 A 10/1997 Shah
6,186,407 B1 2/2001 Hammer et al.
6,220,039 B1 4/2001 Kensok et al.

OTHER PUBLICATIONS

Derwent Abstract of SU 1442895, inventor Chelyadino, V. et al, publishedd Dec. 7, 1988.*

* cited by examiner

*Primary Examiner*—Teresa J. Walberg
(74) *Attorney, Agent, or Firm*—Gregory Ansems

(57) ABSTRACT

Methods and apparatus for controlling a climate control system for an enclosure, including a controller for operating a cooling system and a humidification system. The cooling system is operated to maintain the temperature of the air within the enclosure at a specified value, and the humidification system is operated to maintain the humidity of the air within the enclosure at a specified value. Provisions are made to help ensure that the humidification system does not provide water to the air during periods when the minimum value of the temperature of the air provided by the cooling system is below the dew point temperature of the air.

30 Claims, 7 Drawing Sheets

HUMIDITY CONTROLLER

FIELD OF THE INVENTION

The present invention relates generally to methods and devices for controlling a climate control system for an enclosure. More particularly, the present invention relates to methods and devices for operating a cooling system and a humidifier for cooling and humidifying the air that is provided to the enclosure.

BACKGROUND OF THE INVENTION

Conventional thermostats control the operation of cooling systems in response to an increase or decrease in the temperature of the air within an enclosure. Typically, the occupant of the enclosure specifies a temperature set point that the thermostat attempts to maintain by operating the climate control system. During the cooling mode of operation, the thermostat activates the cooling system when the temperature of the air within the enclosure rises above the occupant specified temperature set point, and de-activates, or suppresses, the cooling system when the temperature of the air within the enclosure falls below the occupant specified temperature set point.

In moderate moist climate regions, the cooling system often includes one or more cooling coils for cooling the air that is provided to the enclosure. A compressor is typically used to provide refrigerant to the coils when cooling is desired. A humidifier, if present, is typically not used during the cooling season.

In hot and arid climatic regions, the cooling system often include a cooler as described above, or an air washer or "swamp cooler" for cooling and humidifying the air within the enclosure. In an air washer system, the warm and often dry air is passed through a chamber having one or more banks of spray nozzles, a sump, an externally mounted pump, and one or more staggered metal baffles at the chamber's exit. When the thermostat within the enclosure indicates a need for cooling, water is withdrawn from the sump by the external pump and sprayed into the chamber in fine droplets. Air withdrawn from the enclosure and/or from the external environment is blown through the chamber and thereby exposed to the water spray therein. The warm air flowing through the chamber is subjected to evaporative cooling and some humidification. The one or more staggered metal baffles, often called "eliminator plates", at the exit of the chamber help minimize physical carry-over of water droplets with the air steam. In an air washer system, there is typically no provision for controlling the amount of water that's added to the air stream. Other cooling systems are also commonly used.

One disadvantage of many cooling systems is that if too much water is added to the system, condensation of the water may occur within the ductwork of the system and/or within the enclosure itself. If insufficient water is added to the system, the air within the enclosure can become too dry. The presence of too much or too little moisture can encourage growth of mold and mildew, cause health problems, and/or in some cases, damage the structure, furnishings and other contents of the enclosure.

SUMMARY OF THE INVENTION

The present invention provides methods and devices for cooling and humidifying the air within the enclosure. In one illustrative embodiment of the present invention, an air stream is passed through a cooling system, a humidifier, and ultimately to the enclosure. The cooling system is used to cool the air that is provided to the enclosure, and the humidifier is used to add water to the air that is provided to the enclosure. To help control the amount of water that is added to the air, and in one illustrative embodiment, a measure of the dew point temperature and a measure of the temperature of the air may be determined. If the temperature of the air is below the dew point temperature, the humidifier may be suppressed. If, however, the temperature of the air is above the dew point temperature, the humidifier may not be suppressed. In some cases, the humidification may be suppressed when the cooling system is activated, and not suppressed after the cooling system is deactivated.

In some embodiments of the present invention, the climate control system may include provisions for fan over-run whereby the indoor air circulation fan is permitted to continue operating for a duration of time after de-activating the cooling system and before activating the humidifier. In such an embodiment, the air stream through the cooling system may continue to be cooled by cooling energy stored within the thermal mass of the cooling system. The air stream may also be evaporatively cooled by water condensate on the one or more cooling coils, and any residual condensate in the coil drip pans, if present. The humidifier may then be activated if a need for humidification is indicated, and if the temperature of the air stream exiting the last of the one or more cooling coils during a cooling cycle is greater than the dew-point temperature of the air.

DETAILED DESCRIPTION OF THE INVENTION

The following detailed description should be read with reference to the drawings, in which like elements in different drawings are numbered in like fashion. The drawings, which are not necessarily to scale, depict selected embodiments and are not intended to limit the scope of the invention. Those skilled in the art will recognize that many of the examples provided may have suitable alternatives that could be utilized without departing from the spirit of the present invention.

Figure 1:
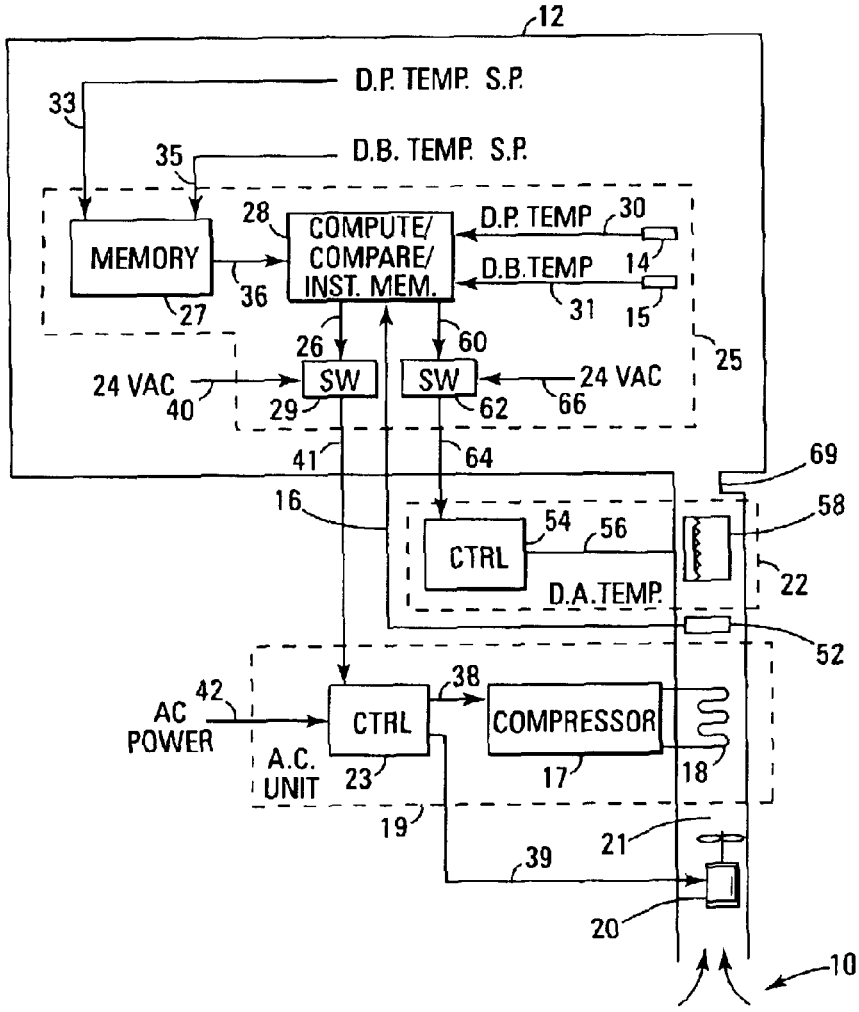
FIG. 1 illustrates an enclosure climate control system of the present invention.

FIG. 1 illustrates one illustrative embodiment of the present invention as implemented in a controller 25 of a climate control system for an enclosure 12 in a hot and arid climatic region. Enclosure 12 receives conditioned air from a conventional air conditioning unit 19 and a conventional humidification unit 22 through ductwork 69.

Air conditioning unit 19 operates on externally supplied AC power provided on conductors 42 to control element 23.

Control element 23 switches power to compressor 17 and blower 20 on conductors 38 and 39 respectively, thereby providing sequencing as needed for their operation. Compressor 17 provides liquid coolant to evaporator (or cooling coil) 18 located within plenum 21 along with blower 20 and humidifier 58. Cooling coil 18 may include one or more evaporators, although only one cooling coil is shown for illustration purposes. Air conditioning unit 19 operates while a demand signal is present on path 26. The demand signal on path 26 closes switch 29, allowing control current supplied by a 24 VAC source on path 40 to flow to the air conditioning unit controller 23 on path 41.

Humidification unit 22 operates on power provided on path 64. Humidifier 58 is shown located in plenum 21 and operates to humidify the air passing through plenum 21 to duct 69. Control element 54 switches power to humidifier 58 on conductor 56, thereby providing sequencing as needed for operating humidifier 58. Humidifier 58 may include, and is not limited to one or more of the following: steam, water spray, pad, drip mesh, etc. Humidifier 58 operates when a demand signal is present on path 60. The demand signal on path 60 closes switch 62, allowing control current supplied by a 24 VAC source on path 66 to flow to humidifier controller 54 on path 64.

While air conditioning unit 19 is operating, fan 20 first forces air 10 across cooling coil 18 to cool, and dehumidify air 10 (if it contains excess water), and then across humidifier 58 to add water to air 10 if and as needed as directed by the presence or absence of a demand signal on path 60. Air 10 may include re-circulation air drawn from enclosure 12, and/or air drawn from the external environment interacting with enclosure 12, and/or a combination of re-circulation air and air from the external environment. The conditioned air then flows into enclosure 12 through duct 69 to maintain both the desired temperature and humidity of the air within enclosure 12.

The demand signals on paths 26 and 60 are provided by controller 25. Controller 25 will typically be attached to a wall of enclosure 12 in the manner done for conventional thermostats. Controller 25 may include memory 27 which can store digital data, and processor 28 which can perform computation and comparison operations on data supplied to it from both memory 27 and from external sources. Processor 28 also includes an instruction memory element. In one embodiment, a conventional micro-controller may be used to function as memory 27 and processor 28.

Controller 25 further includes sensor 14, located within enclosure 12, which provides a dew-point temperature signal on path 30 encoding the dew-point temperature of the air within enclosure 12, but alternatively may encode the wet-bulb temperature or the relative humidity of the air within enclosure 12. Temperature sensor 15, also located within enclosure 12, encodes a dry-bulb temperature value in an air temperature signal on path 31. In one embodiment of the present invention, sensor 52, located within plenum 21 and between humidifier 58 and the last of the one or more cooling coil 18, may encode on path 16, a dry-bulb temperature value of the air entering humidifier 58. In an alternate embodiment, sensor 52 may encode on path 16, a dew-point temperature value of the air entering humidifier 58. In another embodiment, sensor 52 may encode on path 16, a signal representing the presence or absence of water condensate on the one or more cooling coils 18 and/or the presence or absence of water condensate in the drip pans of the one or more cooling coils 18. In the illustrative embodiment, processor 28 receives these temperature signals and converts them to digital values for internal operations.

Paths 33 and 35 carry signals to memory 27 encoding various set point values. Typically the signals on paths 33 and 35 are provided by the person responsible for controlling the climate of enclosure 12. The set point values may be selected by simply shifting control levers or dials on the exterior of controller 25. The values may also be selected by a keypad which provides digital values for the set points in the signals on paths 33 and 35. Path 33 carries a dew-point temperature signal encoding a dew-point temperature set point value representative of the desired dew-point temperature within enclosure 12. This dew-point temperature set point value may be the actual desired dew-point temperature, or the desired relative humidity, or the desired wet-bulb temperature. Path 35 carries a signal encoding an air (dry-bulb) temperature set point value. Memory 27 records these set point values, and encodes them in set point signals carried to processor 28 on a path 36. If memory 27 and processor 28 are formed of a conventional microcontroller, the procedures by which these set point values are provided to processor 28, when needed, are included in further circuitry not shown which provides a conventional control function for the overall operation of such a microcontroller. In some cases, processor unit 28 has internal to it, a read-only memory (ROM) in which a sequence of control instructions are stored and executed by processor unit 28.

Figure 2:
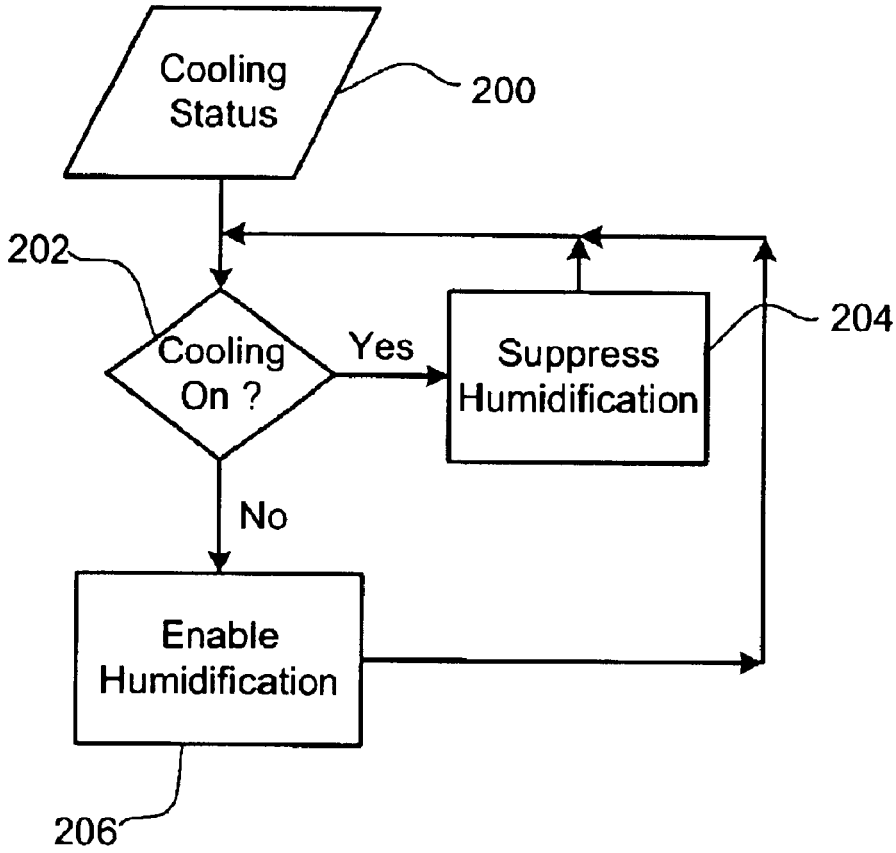
FIG. 2 is an overview of the cooling and humidification process.

Turning now to FIGS. 2 through 7, top level overviews and different embodiments of the overall cooling and humidification process are illustrated. It should be noted that the steps for the humidification process are in addition to the temperature control algorithms in a conventional thermostat. FIG. 2 is a high level overview of the cooling and humidification process. From the conventional thermostat, the operating status of the cooling system is provided in block 200. The operating status, i.e., "on" or "off", is next checked in decision block 202. If the cooling system is "on", then humidification of the air stream is suppressed as shown in block 204, and the process control is passed back to decision block 202 for determining the operating status of the cooling system. If, however, the cooling system is "off", then the humidification system may be enabled in block 206, and process control is transferred to decision block 202 as described above.

Figure 3:
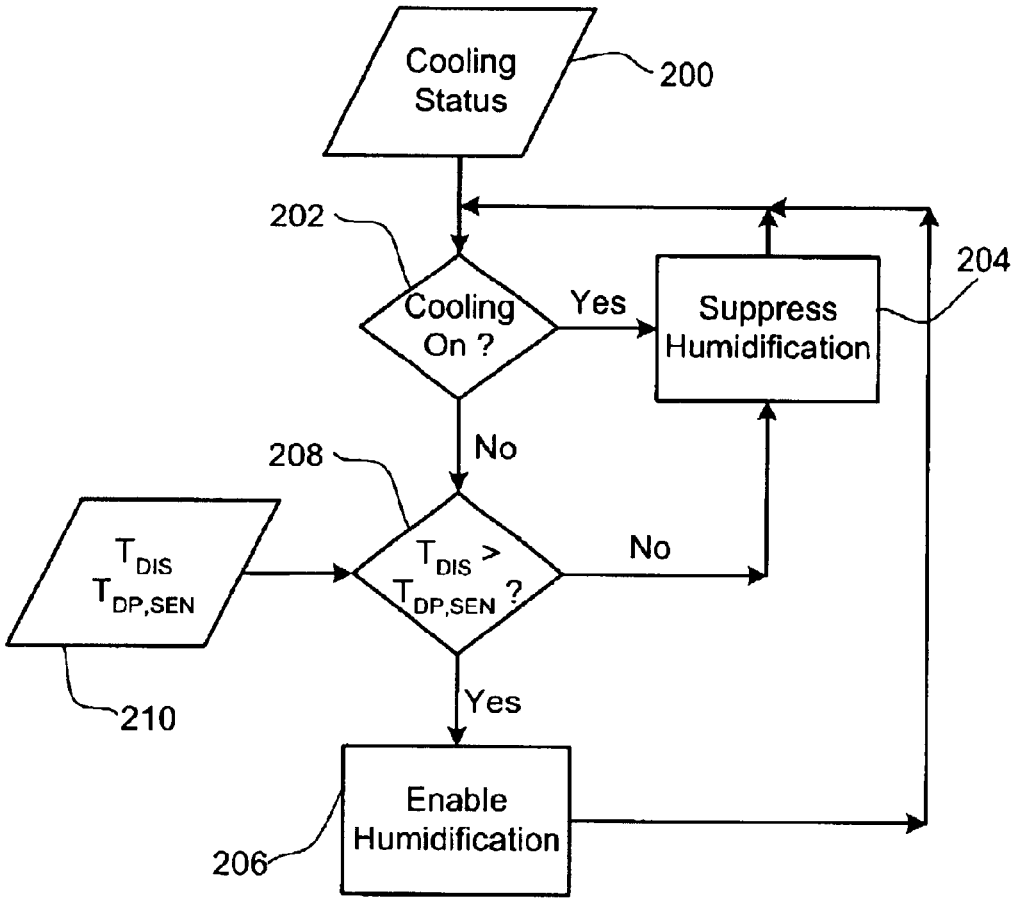
FIG. 3 illustrates the next level of detail for the process of FIG. 2.

FIG. 3 adds additional steps to the process of FIG. 2. As shown in FIG. 3, if decision block 202 indicates that the cooling system is "off", then the sensed dew-point temperature of the air, $T_{DP,SEN}$, and the minimum temperature of the air exiting the last of one or more cooling coils of the cooling system, $T_{DIS}$, are provided as inputs (210) to the control algorithms. In one embodiment of the present invention, $T_{DIS}$ may be the minimum temperature of the air from the current or the most recently concluded cooling cycle. In an alternate embodiment of the present invention, $T_{DIS}$ may be the minimum temperature of the air over a predefined duration of time, for example, 2 hours, 12 hours, or 24 hours. The values of $T_{DP,SEN}$ and $T_{DIS}$ are then compared in decision block 208. If $T_{DIS}$ is less than $T_{DP,SEN}$, then the air stream can not be humidified since any addition of water to the air stream will result in condensate on the one or more cooling coils during the subsequent cooling cycle, thereby removing the moisture added by the humidifier. If $T_{DIS}$ is greater than $T_{DP,SEN}$, then water may be added to the air stream by enabling the humidifier (206). Thus, $T_{DIS}$ effectively becomes the upper limit of the dew point temperature within the space, even if $T_{DIS}$ is less than the dew-point temperature set-point, $T_{DP,SET}$.

Figure 4:
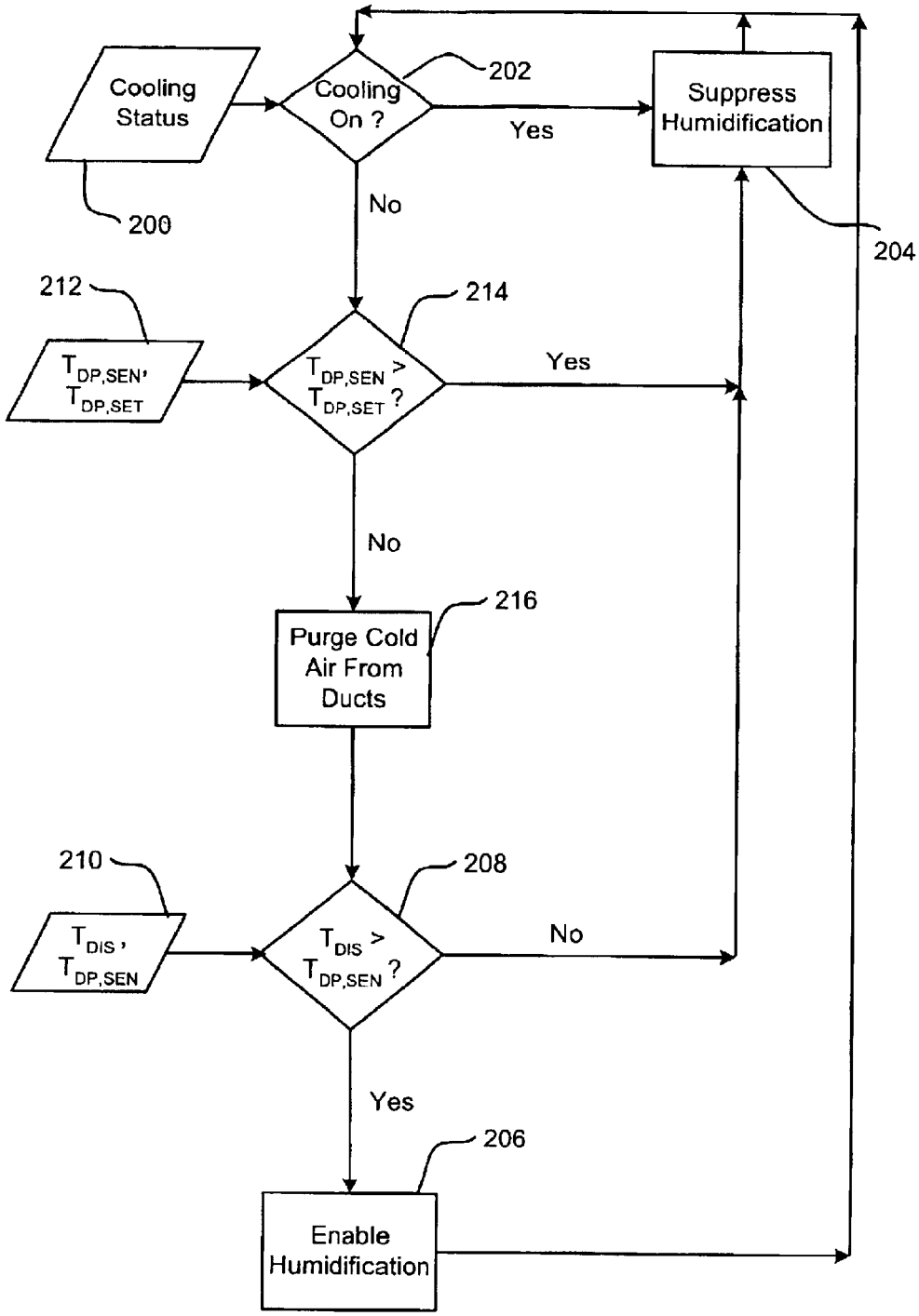
FIG. 4 is a flowchart for one embodiment of the present invention.

FIG. 4 illustrates the process for one embodiment of the present invention. If decision block 202 indicates that the cooling system is "off", then the sensed dew-point temperature of the air, $T_{DP,SEN}$, and the dew-point temperature set-point for the air within the enclosure, $T_{DP,SET}$, are provided as inputs from block 212. Next, decision block 214 compares the values of $T_{DP,SEN}$ and $T_{DP,SET}$. If $T_{DP,SEN}$ is greater than $T_{DP,SET}$, then humidification may be suppressed (204). If $T_{DP,SEN}$ is not greater than $T_{DP,SET}$, then any cooling energy stored within the thermal mass of the one or more cooling coils of the cooling system may be extracted by "fan over-run" (216), i.e., continuing running fan 20 for a period of time after the cooling system is turned "off". The duration of fan over-run may be for a pre-specified period of time, or may be a function of the temperature of air 10 and the discharge air temperature $T_{DIS}$, or any other suitable method. At the end of fan over-run, water may be added to the air stream by enabling humidification (206) by continuing operating fan 20. It should be noted that fan over-run, in addition to extracting cooling energy stored within the thermal mass of the one or more coils, may extract cooling energy stored within the thermal mass of the ductwork. Furthermore, fan over-run may evaporatively cool and humidify the air steam with any residual water condensate on the one or more cooling coils and their drip pans.

Figure 5:
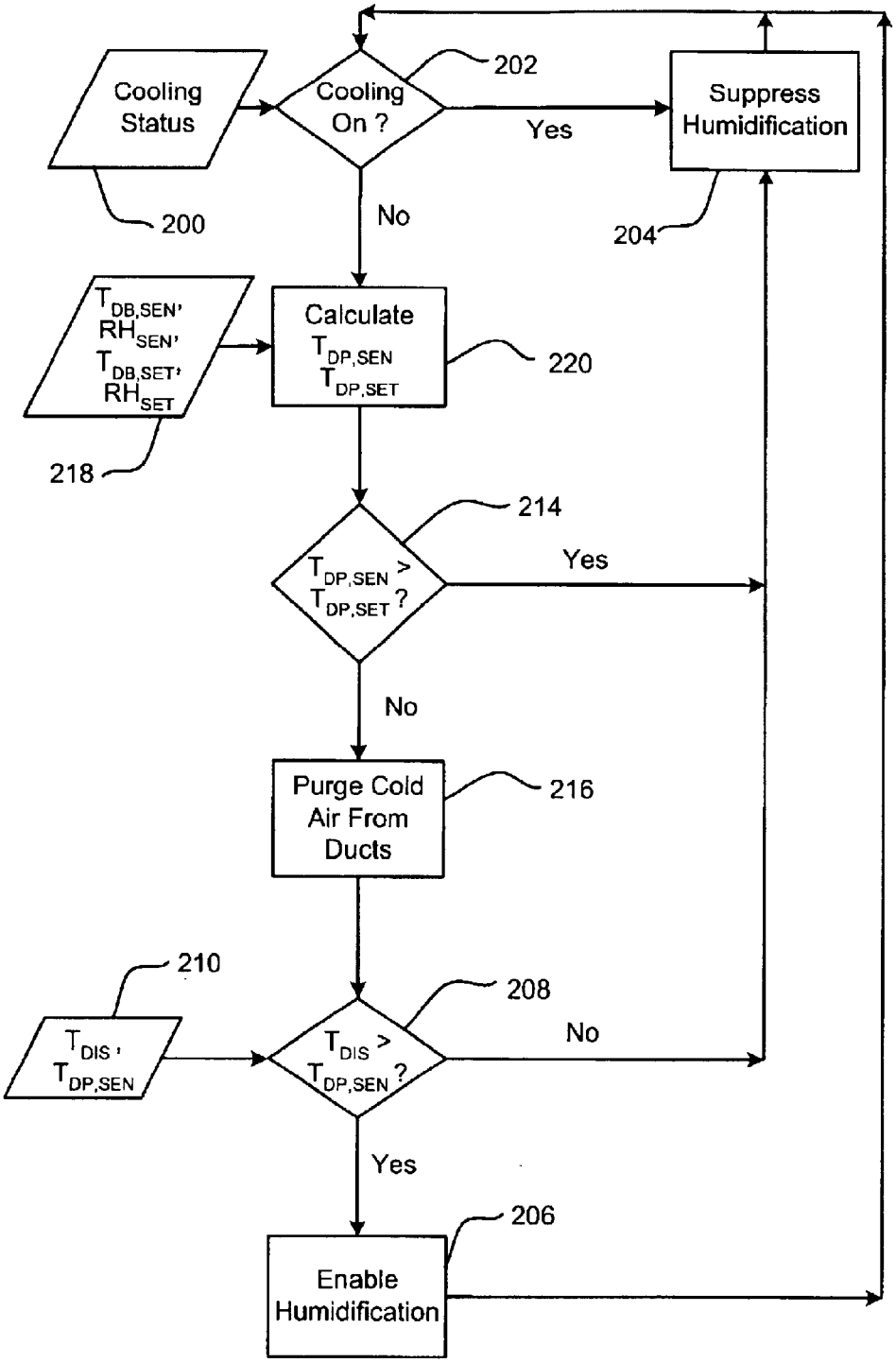
FIG. 5 illustrates the process for another embodiment of the present invention.

FIG. 5 illustrates the process for another embodiment of the present invention. If decision block 202 indicates that the cooling system is "off", then block 218 provides as inputs: the sensed dry-bulb temperature of the air, $T_{DB,SEN}$; the sensed relative humidity of the air, $RH_{SEN}$; the dry-bulb temperature set-point for the air within enclosure 12, $T_{DB,SET}$; and the relative humidity set-point for the air within enclosure 12, $RH_{SET}$. Next, process block 220 computes the sensed dew-point temperature of the air, $T_{DP,SEN}$, as a function of $T_{DB,SEN}$ and $RH_{SEN}$, and the dew-point temperature set-point for the air within the enclosure, $T_{DP,SET}$, as a function of $T_{DB,SET}$ and $RH_{SET}$. Values of $T_{DP,SEN}$ and $T_{DP,SET}$ are compared in decision block 214. If $T_{DP,SEN}$ is greater than $T_{DP,SET}$, then humidification may be suppressed (204) because it is not required. If $T_{DP,SEN}$ is not greater than $T_{DP,SET}$, then fan over-run is initiated (216) as previously described.

Figure 6:
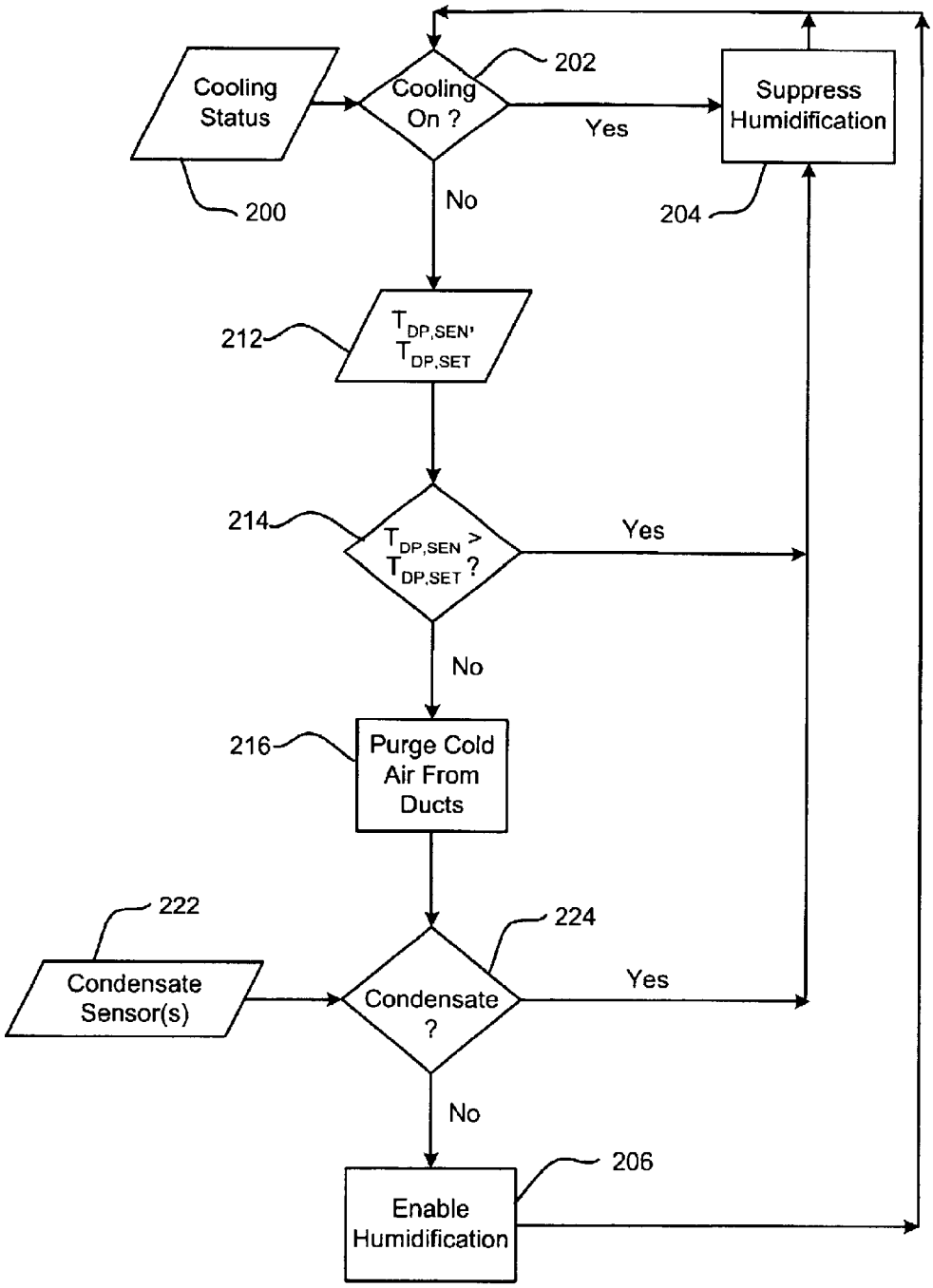
FIG. 6 is a flowchart for yet another embodiment of the present invention.

FIG. 6 illustrates the process for yet another embodiment of the present invention. If decision block 214 indicates the need for humidification, then fan over-run is initiated (216). During this period of fan over-run immediately following a cooling cycle, one or more condensate sensors 222 provide input about whether or not water condensate is present on the one or more cooling coils or in their drip-pans. Condensate sensors 222 may include liquid water sensors, or dry-bulb temperature and dew-point temperature sensors, or relative humidity and dry-bulb temperature sensors, or any other suitable sensor or device. If decision block 224 determines the presence of water condensate, then humidification is suppressed by passing control to process block 204. If decision block 224 indicates the absence of water condensate, then humidification is enabled by passing control to process block 206.

Figure 7:
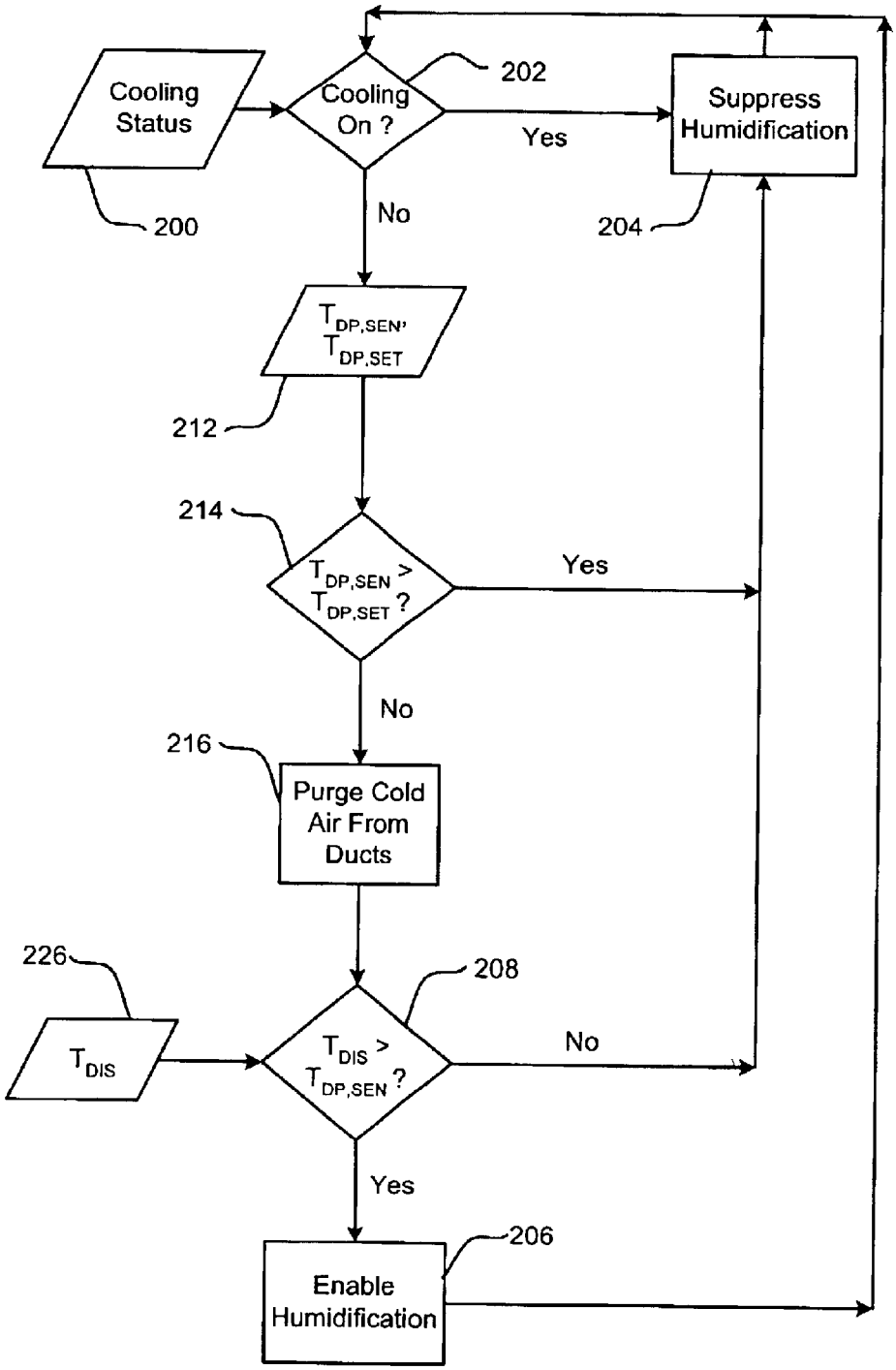
FIG. 7 illustrates the process for yet another embodiment of the present invention.

FIG. 7 illustrates the process for another embodiment of the present invention. During each cooling cycle, if decision block 214 indicates the need for humidification, then fan over-run is initiated (216). During this period of fan over-run, the minimum dry-bulb temperature of the air discharged from the one or more cooling coils, $T_{DIS}$, during a cooling cycle is provided as input (226) to decision block 228. If decision block 228 determines that $T_{DIS}$ is not greater than $T_{DP,SEN}$, then humidification is suppressed by passing control to process block 204 since any addition of water to the air stream will result in condensation on the one or more cooling coils during the subsequent cooling cycle, thereby effectively negating humidification. If decision block 228 determines that $T_{DIS}$ is greater than $T_{DP,SEN}$, then humidification is enabled by passing control to process block 206.

Although the methods illustrated in FIGS. 2–7 indicated that humidification is suppressed when the cooling system is "on", this is not required. For example, if the temperature of the air provided by the cooling system is above the dew point temperature of the air by a preset value, then humidification need not be suppressed.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proper by way of example to facilitate comprehension of the inventions and should not be construed to limit the scope thereof.

We claim:

1. A method for controlling a climate control system for a building enclosure, the climate control system having a cooling system for cooling the air that is provided to the building enclosure through one or more ducts and a humidifier for adding water to the air that is provided to die building enclosure through the one or more ducts, the method comprising the steps of:

activating the cooling system to cool the air that is provided to the building enclosure via the one or more ducts; and suppressing the humidifier when the cooling system is activated so that the humidifier does not add a substantial amount of water to the air that is provided to the building enclosure via the one or more ducts.

2. A method according to claim 1, further comprising the steps of:

deactivating the cooling system; and activating the humidifier after the cooling system is deactivated.

3. A method according to claim 2, further comprising the steps of:

determining a measure of the dew point temperature of the air;

determining a measure of the temperature of the air; and activating the humidifier after the temperature of the air rises above the dew point temperature of the air.

4. A method according to claim 3, wherein the cooling system is an air conditioning system having one or more cooling coils, and wherein the measure of the temperature of the air passing through the one or more cooling coils during a cooling cycle represents the temperature of the one or more cooling coils.

5. A method according to claim 3, wherein the measure of the temperature of the air is obtained via a temperature sensor positioned downstream of the one or more cooling coils.

6. A method according to claim 5, further comprising the step of determining and storing in memory a minimum value of the temperature of the air.

7. A method according to claim 3, wherein the climate control system includes a fan, the method further comprising the step of continuing to run the fan after the cooling system is deactivated.

8. A method according to claim 2, further comprising the steps of:

determining a measure of the dew point temperature of the air;

determining a measure of the temperature of the air; and activating the humidifier after the dew point temperature of the air is less than a dew point temperature set point value for the air within the building enclosure and after the temperature of the air rises above the dew point temperature of the air.

9. A method according to claim 8, further comprising the steps of:

determining a minimum value of the temperature of the air; and activating the humidifier after the dew point temperature of the air is less than a dew point temperature set point value for the air within the building enclosure and after the minimum value of the temperature of the air rises above the dew point temperature of the air.

10. A method according to claim 8, wherein the temperature of the air is the dry-bulb temperature.

11. A method according to claim 2, further comprising the steps of:

determining if there is condensation of water on the one or more cooling coils; and activating the humidifier if and when there is substantially little or no condensation of water on the one or more cooling coils during or after the cooling system is deactivated.

12. A method according to claim 2, further comprising the steps of:

determining if there is condensation of water on the one or more cooling coils after the humidifier is activated; and suppressing the humidifier if there is condensation of water on the one or more cooling coils.

13. A method according to claim 2, wherein operating the cooling system has priority over operating the humidifier.

14. A method for controlling a climate control system for a building enclosure, the climate control system having a cooling system for cooling the air that is provided to the building enclosure through one or more ducts and a humidifier for adding water to the air that in provided to the building enclosure through the one or more ducts, the method comprising the steps of:

determining a measure of the dew point temperature of the air;

determining a measure of the temperature of the air; and suppressing the humidifier from activating if the temperature of the air is below the dew point temperature of the air.

15. A method according to claim 14, further comprising the steps of:

determining the minimum value of the temperature of the air; and suppressing the humidifier from activating if the minimum value of the temperature of the air in below the dew point temperature of the air.

16. An apparatus for controlling a climate control system for a building enclosure, the climate control system having a cooling system for cooling the air that is provided to the building enclosure through one or more ducts and a humidifier fur adding water to the air that is provided to the building enclosure through the one or mare ducts, the apparatus comprising:

means for determining the operating status of the cooling system; and means for suppressing the humidifier when the cooling system is activated so that the humidifier does not add a substantial amount of water to the air that is provided to the building enclosure via the one or mare ducts.

17. An apparatus according to claim 16, further comprising:

means for deactivating the cooling system; and means for activating the humidifier after the cooling system is deactivated.

18. An apparatus according to claim 17, further comprising:

means for determining a measure of the dew point temperature of the air;

means for determining a measure of the temperature of the air; and said means for activating the humidifier activating the humidifier after the temperature of the air rises above the dew point temperature of the air.

19. An apparatus according to claim 18 further comprising:

means for determining the minimum value of the temperature of the air; and said means for activating the humidifier activating the humidifier after the minimum value of the temperature of the air rises above the dew point temperature of the air.

20. An apparatus according to claim 19, wherein the cooling system is an air conditioning system having one or more cooling coils, and wherein the means for determining the minimum value of the temperature of the air is a temperature sensor positioned downstream of the one or more cooling coils.

21. An apparatus according to claim 19, wherein the means for determining the minimum value of the temperature of the air is a temperature sensor positioned proximate the one or more cooling coils.

22. An apparatus according to claim 19, wherein the minimum value of the temperature of the air that is provided to the building enclosure represents the temperature of the one or more cooling coils.

23. An apparatus according to claim 19, wherein the climate control system includes a fan, the apparatus further comprising means for continuing to run the fan after the cooling system is deactivated.

24. An apparatus according to claim 17, further comprising:

means for determining if there is condensation of water on the one or more cooling coils; and means for activating the humidifier if and when there is substantially little or no condensation of water on the one or more cooling coil during or after the cooling cycle is deactivated.

25. An apparatus according to claim 17, further comprising:

means for determining if there is condensation of water on the one or more cooling coils after the humidifier is activated; and means for suppressing the humidifier if there is condensation of water on the one or more cooling coils.

26. An apparatus for controlling a climate control system for a building enclosure, the climate control system having a cooling system for cooling the air that is provided to the building enclosure through one or more ducts and a humidifier for adding water to the air that is provided to the building enclosure through the one or more ducts, the apparatus comprising:

means for determining a measure of the dew point temperature of the air that is provided to the building enclosure through the one or more ducts;

means for determining a measure of the temperature of the air that is provided to the building enclosure through the one or more ducts; and means for suppressing the humidifier from activating if the temperature of the air is below the dew point temperature of the air.

27. An apparatus according to claim 26, further comprising:

means for determining the minimum value of the temperature of the air; and means for suppressing the humidifier from activating if the minimum value of the temperature of the air is below the dew point temperature of the air.

28. A controller for a cooling system for a controlled space, the cooling system including a cooling device, a ventilation system including a fan and ducts, and a humidifier, the cooling device and humidifier both placed to change the characteristics of air passing through the ducts, the controller comprising operational circuitry for performing the following steps:

determining whether the cooling device is activated;

if the cooling device is activated, suppressing the humidifier; and if the cooling device is not activated, determining whether predetermined conditions exist indicating whether humidification is desirable; and:

if humidification is desirable, activating the humidifier; or if humidification is not desirable, suppressing the humidifier.

29. The controller of claim 28 wherein the predetermined conditions for indicating whether humidification is desirable includes characteristics of air within the ventilation system.

30. The controller of claim 29 wherein the predetermined conditions for indicating whether humidification is desirable includes characteristics of air within the controlled space.

* * * * *